US007534089B2

(12) United States Patent
Liang

(10) Patent No.: US 7,534,089 B2
(45) Date of Patent: May 19, 2009

(54) TURBINE AIRFOIL WITH NEAR WALL MULTI-SERPENTINE COOLING CHANNELS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 317 days.

(21) Appl. No.: 11/488,564

(22) Filed: Jul. 18, 2006

(65) Prior Publication Data

US 2009/0104042 A1 Apr. 23, 2009

(51) Int. Cl.
*F01D 5/08* (2006.01)
*F01D 5/18* (2006.01)

(52) U.S. Cl. ..... 416/97 R; 415/115; 416/233

(58) Field of Classification Search ..... 415/115; 416/97 R, 232, 233
See application file for complete search history.

(56) References Cited

U.S. PATENT DOCUMENTS 5,484,258 A * 1/1996 Isburgh et al. ..... 415/115
5,538,394 A 7/1996 Inomata et al.
5,667,359 A * 9/1997 Huber et al. ..... 416/96 A
5,702,232 A * 12/1997 Moore ..... 416/95
6,099,251 A 8/2000 LaFleur
6,174,133 B1 * 1/2001 Bunker ..... 416/97 R
6,264,428 B1 * 7/2001 Dailey et al. ..... 416/97 R
6,331,098 B1 12/2001 Lee
6,533,547 B2 * 3/2003 Anding et al. ..... 416/97 R
6,916,150 B2 7/2005 Liang
6,932,573 B2 8/2005 Liang
6,981,846 B2 1/2006 Liang
7,029,235 B2 * 4/2006 Liang ..... 416/92
7,033,136 B2 * 4/2006 Botrel et al. ..... 415/115
2005/0111979 A1 5/2005 Liang
2005/0265837 A1 12/2005 Liang

FOREIGN PATENT DOCUMENTS

GB 2202907 A 10/1988

* cited by examiner

*Primary Examiner*—Igor Kershteyn

(57) ABSTRACT

A turbine airfoil usable in a turbine engine and having at least one cooling system. At least a portion of the cooling system may be positioned in an outer wall of the turbine airfoil and be formed from at least one suction side serpentine cooling chamber and at least one pressure side serpentine cooling chamber. Each of the suction and pressure side serpentine cooling channels may receive cooling fluids from a cooling fluid supply source first before being passed through other components of the cooling system. The cooling fluids may then be passed into a mid-chord cooling chamber to cool internal aspects of the turbine airfoil, yet prevent creation of a large temperature gradient between outer surfaces of the turbine airfoil and inner aspects.

19 Claims, 4 Drawing Sheets

TURBINE AIRFOIL WITH NEAR WALL MULTI-SERPENTINE COOLING CHANNELS

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to an inner endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing through these cooling circuits is exhausted through orifices in the leading edge, trailing edge, suction side, and pressure side of the vane. While advances have been made in the cooling systems in turbine vanes, a need still exists for a turbine vane having increased cooling efficiency for dissipating heat and passing a sufficient amount of cooling air through the vane.

SUMMARY OF THE INVENTION

This invention relates to a turbine vane having an internal cooling system for removing heat from the turbine airfoil. The turbine airfoil cooling system may be formed from a cooling system having a plurality of cooling channels. For instance, the cooling channels may include one or more suction side serpentine cooling channels positioned in an outer wall forming a suction side of the turbine airfoil and may include one or more pressure side serpentine cooling channels positioned in an outer wall forming a pressure side of the turbine airfoil. The cooling system may be configured such that cooling fluids are received by the suction and pressure side serpentine cooling channels from a cooling fluid supply source first before being passed through other components of the cooling system. The suction side and pressure side serpentine cooling chambers may each be divided into a forward and an aft suction side and pressure side serpentine cooling chambers, respectively, thereby forming separate cooling channels.

The turbine airfoil may be formed from a generally elongated hollow airfoil having a leading edge, a trailing edge, a pressure side, a suction side, an outer endwall at a first end, an inner endwall at a second end opposite the first end, and a cooling system in the outer wall. The cooling system may include suction and pressure side serpentine cooling chambers positioned in the outer wall forming the suction side of the airfoil. The suction side serpentine cooling chamber may include first and second suction side serpentine cooling chambers. Each suction side serpentine cooling chamber may be formed from first and second legs generally aligned with each other and positioned generally spanwise in the outer wall forming the suction side. The first suction side leg may receive cooling fluids from a cooling fluid supply source, and a second suction side leg of the suction side serpentine cooling chamber may be positioned between the first suction side leg and the leading edge of the generally elongated airfoil. In another embodiment, the first and second suction side serpentine cooling chambers may each include a third leg. The third leg of the first suction side serpentine cooling chamber, which is the aft cooling chamber, may be in fluid communication with a mid-chord cooling fluid collection chamber.

The pressure side serpentine cooling chamber may include first and second pressure side serpentine cooling chambers. Each pressure side serpentine cooling chamber may be formed from first and second legs generally aligned with each other and positioned generally spanwise in the outer wall forming the suction side. The first pressure side leg may receive cooling fluids from a cooling fluid supply source, and a second suction side leg of the pressure side serpentine cooling chamber may be positioned between the first pressure side leg and the leading edge of the generally elongated airfoil. In other embodiment, the first and second pressure side serpentine cooling chamber may each include a third leg. The third leg of the first pressure side serpentine cooling chamber, which is the aft cooling chamber, may be in fluid communication with a mid-chord cooling fluid collection chamber.

The cooling system may also include one or more leading edge cooling chambers extending generally spanwise along the leading edge of the generally elongated hollow airfoil. In one embodiment, the cooling system may include two leading edge cooling chambers, a first in fluid communication with the suction side serpentine cooling chamber and a second in fluid communication with the pressure side serpentine cooling chamber. The cooling system may also include one or more mid-chord cooling fluid collection chambers positioned between the leading and trailing edges and between the pressure and pressure side serpentine cooling channels. The suction side serpentine cooling chamber may be in fluid communication with the at least one leading edge cooling chamber through at least one suction side vortex orifice, and the pressure side serpentine cooling chamber may be in fluid communication with the at least one leading edge cooling chamber through at least one pressure side vortex orifice. The leading edge cooling chamber may be in fluid communication with the at least one mid-chord cooling fluid collection chamber through at least one orifice in a rib separating the at least one leading edge cooling chamber from the at least one mid-chord cooling fluid collection chamber. The cooling system may also include at least one trailing edge impingement cavity positioned proximate to the trailing edge and in fluid communication with the at least one mid-chord cooling fluid collection chamber. One or more trailing edge slots may extend from the at least one trailing edge impingement cavity through the outer wall to the trailing edge.

An advantage of this invention is the suction side and pressure side serpentine cooling chambers in the outer wall of the hollow airfoil may be sized and shaped appropriately to account for localized pressures and heat loads to more effectively use available cooling fluids.

Another advantage of this invention is that the compartmental leading edge cooling chamber being formed from two vortex forming cooling chambers improves design flexibility and saves cooling fluid flow.

Still another advantage of this invention is that each of the first and second suction side and pressure side serpentine cooling chambers may be independently designed based on local heat loads and aerodynamic pressure loading conditions.

Another advantage of this invention is that the first and second suction side and pressure side serpentine cooling chambers increases the design flexibility to redistribute cooling fluid flow for each section of the airfoil, thereby increasing growth potential for the cooling design.

Yet another advantage of this invention is that having the first and second suction side and pressure side serpentine cooling chambers positioned in the outer wall in a near wall configuration enables the outer wall thickness to be reduced while increasing convection for the airfoil overall, thereby yielding an effective cooling design, especially if the airfoil is coated with a thick thermal boundary coating.

Another advantage of this invention is that the pressure side serpentine cooling chambers are separated from the suction side serpentine cooling chambers, thereby eliminating airfoil mid-chord cooling flow mal-distribution problems inherent in conventional cooling systems.

Still another advantage of this invention is that the first and second suction side and pressure side serpentine cooling chambers are configured to direct cooling fluids in a counterflow direction relative to the gases flowing past the airfoil on the outside, thereby improving the airfoil thermal mechanical fatigue (TMF) capability.

Another advantage of this invention is that cooling fluids are first sent through the first and second suction side and pressure side serpentine cooling chambers and then passed to the mid-chord cooling fluid collection chambers, thereby reducing the temperature gradient in the airfoil between the outer surfaces of the airfoil and the inner aspects.

Yet another advantage of this invention is that the film cooling holes extend from the mid-chord cooling fluid collection chamber to the outer surface of the airfoil, which is very advantageous for airfoils with a thin outer wall in which a well defined film cooling hole is difficult to manufacture.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
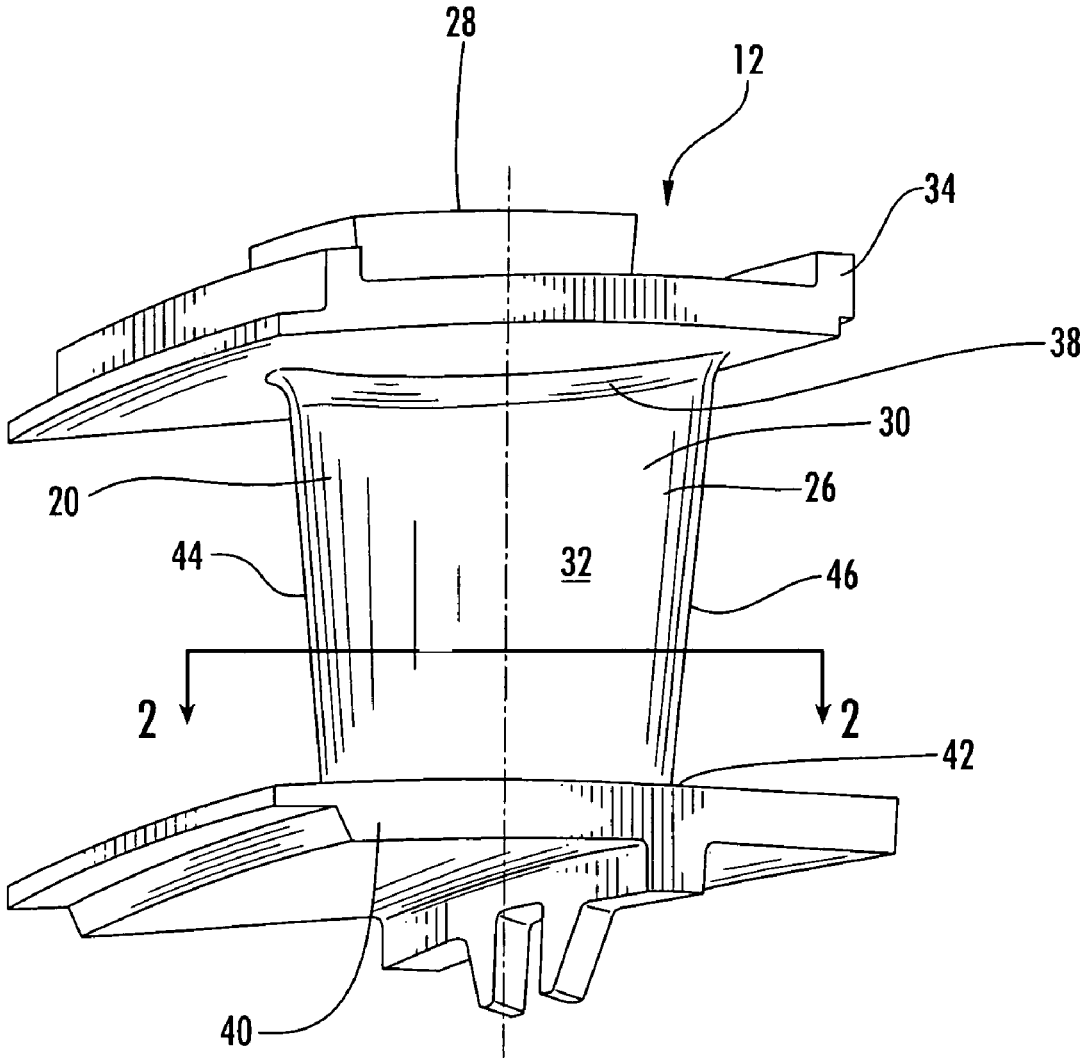
FIG. 1 is a perspective view of a turbine airfoil having features according to the instant invention.

As shown in FIGS. 1-4, this invention is directed to a turbine airfoil cooling system 10 configured to cooling internal and external aspects of a turbine airfoil 12 usable in a turbine engine. In at least one embodiment, the turbine airfoil cooling system 10 may be configured to be included within a stationary turbine vane, as shown in FIGS. 1-4. While the description below focuses on a cooling system 14 in a turbine vane 12, the cooling system 10 may also be adapted to be used in a turbine blade. The turbine airfoil cooling system 10 may be formed from a cooling system 14 having a plurality of cooling channels 16. For instance, the cooling channels 16 may include one or more suction side serpentine cooling channels 18 positioned in an outer wall 20 forming a suction side 22 of the turbine airfoil 12 and may include one or more pressure side serpentine cooling channels 24 positioned in an outer wall 20 forming a pressure side 26 of the turbine airfoil 12. The cooling system 14 may be configured such that cooling fluids are received by the suction and pressure side serpentine cooling channels 18, 24 from a cooling fluid supply source 28 first before being passed through other components of the cooling system 14. As such, the cooling fluids may be used more effectively than used in conventional turbine airfoil cooling systems.

As shown in FIG. 1, the turbine airfoil 12 may be formed from a generally elongated hollow airfoil 30 having an outer surface 32 adapted for use, for example, in an axial flow turbine engine. Outer surface 32 may have a generally concave shaped portion forming the pressure side 26 and a generally convex shaped portion forming the suction side 22. The turbine vane 10 may also include an outer endwall 34 at a first end 38 adapted to be coupled to a hook attachment and may include an inner endwall 40 at a second end 42. The airfoil 22 may also include a leading edge 44 and a trailing edge 46.

Figure 2:
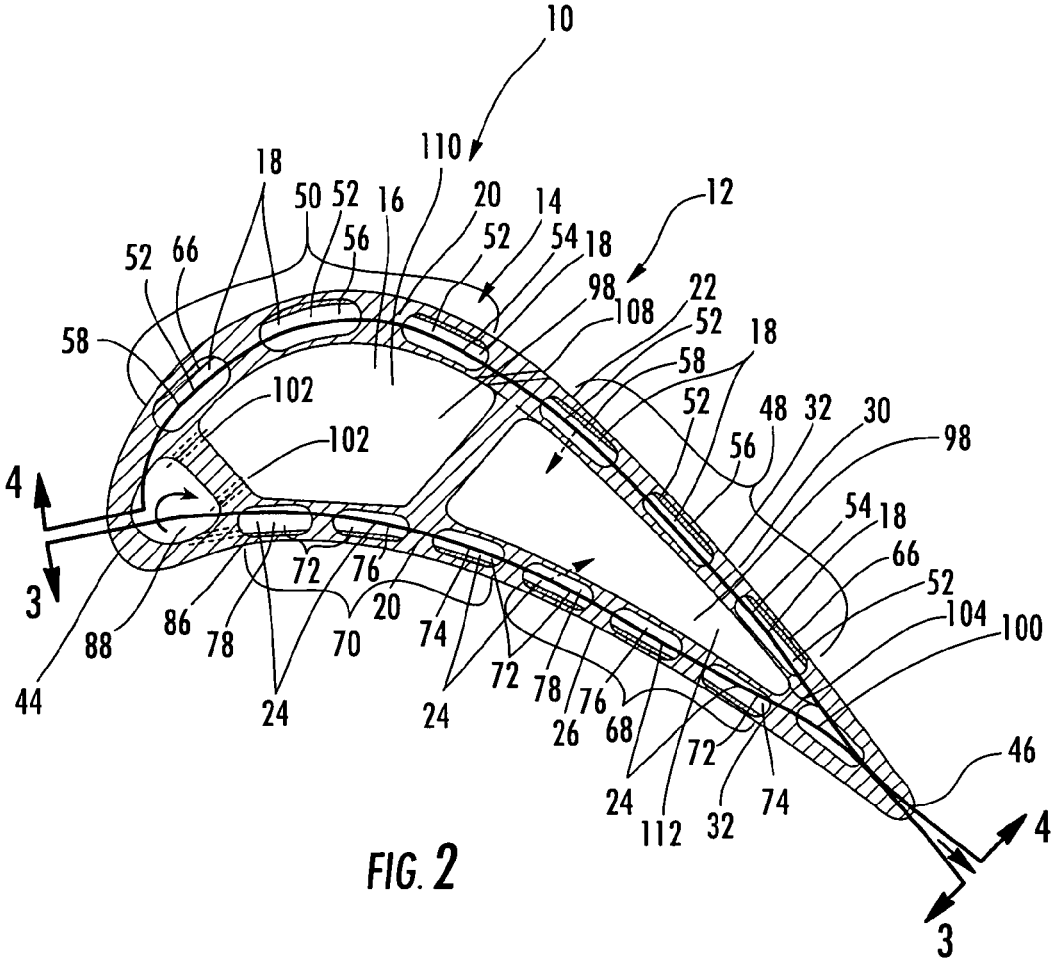
FIG. 2 is a cross-sectional view of the turbine airfoil shown in FIG. 1 taken along line 2-2.
Figure 4:
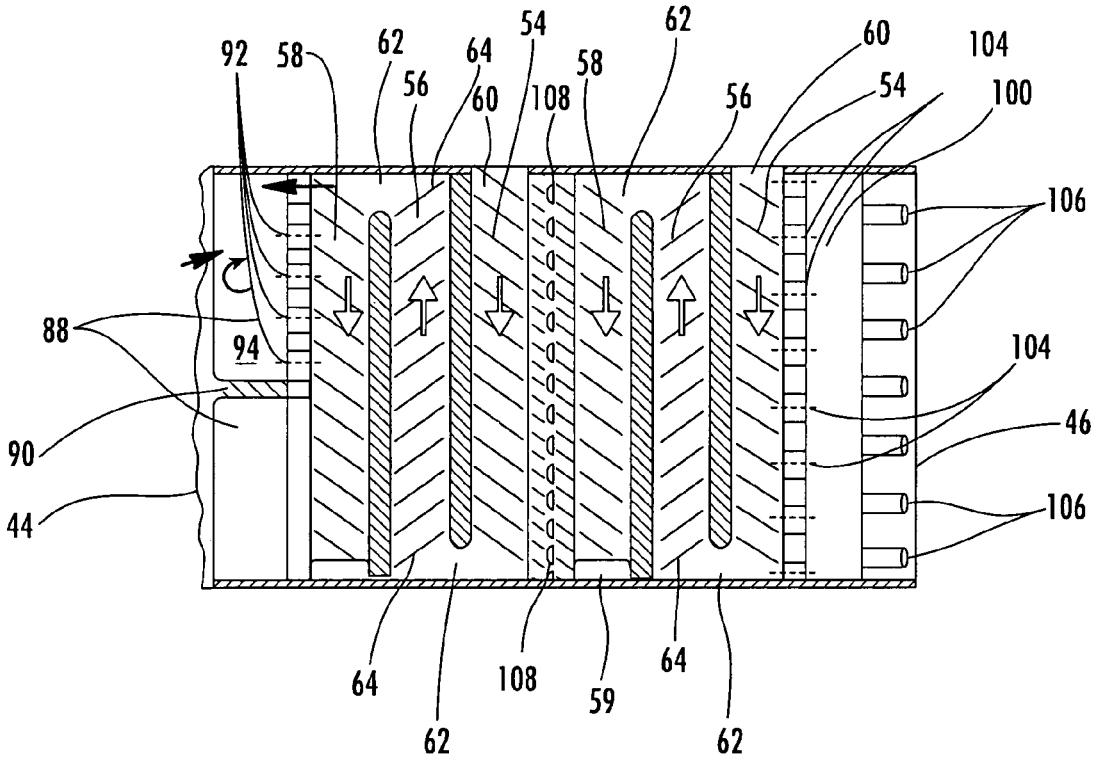
FIG. 4 is a cross-sectional view of a suction side of the cooling system in the turbine airfoil shown in FIG. 2 taken along line 4-4 in FIG. 2.

As shown in FIGS. 2 and 4, the cooling system 10 may include one or more suction side serpentine cooling chambers 18 positioned within the outer wall 20 forming the suction side 22. In at least one embodiment, as shown in FIG. 2, the cooling system 10 may include a first suction side serpentine cooling chamber 48 and a second suction side serpentine cooling chamber 50 positioned in the outer wall 20 forming the suction side 22 of the airfoil 12. Each of the first and second suction side serpentine cooling chambers 48, 50 may include two or more legs 52. The legs 52 may extend from the first end 38 of the generally elongated hollow airfoil 30 to a second end 42 of the generally elongated hollow airfoil 30. In another embodiment, the legs 52 may extend for a shorter length between the first and second ends 38, 42 of the generally elongated hollow airfoil 30.

In at least one embodiment, each of the first and second suction side serpentine cooling chambers 48, 50 may be formed from a first suction side leg 54, a second suction side leg 56, and a third suction side leg 58. The legs 54, 56, 58 may be aligned with each other and may extend in a generally spanwise direction in the elongated airfoil 30. The first and second suction side cooling chambers 48, 50 may be configured such that the first suction side leg 54 may be in communication with a cooling fluid supply source 28 through one or more orifices 60 in the outer endwall 34. The first and second suction side cooling chambers 48, 50 may be configured such that the first suction side leg 54 is positioned closest to the trailing edge 46 and the third suction side leg 58 is positioned closest to the leading edge 46. The second suction side legs 56 may be positioned between the first and third suction side legs 54, 58. In addition, the first, second, and third suction side legs, 54, 56, 58 may be in fluid communication with each other with turns 62. One or more trip strips 64 may be positioned in the first, second, and third suction side legs, 54, 56, 58 and may extend inwardly from an inner surface 66 forming the first, second, and third suction side legs, 54, 56, 58. The third leg 58 of the first suction side serpentine channel 48 may be in fluid communication with a mid-chord cooling fluid collection chamber 98 through one or more orifices 59.

As shown in FIGS. 2 and 4, the cooling system 10 may include one or more pressure side serpentine cooling chambers 24 positioned within the outer wall 20 forming the pressure side 26. In at least one embodiment, as shown in FIG. 4, the cooling system 10 may include a first pressure side serpentine cooling chamber 68 and a second pressure side serpentine cooling chamber 70 positioned in the outer wall 20 forming the pressure side 26 of the airfoil 12. Each of the first and second pressure side serpentine cooling chambers 68, 70 may include two or more legs 72. The legs 72 may extend from the first end 38 of the generally elongated hollow airfoil 30 to a second end 42 of the generally elongated hollow airfoil 30. In another embodiment, the legs 72 may extend for a shorter length between the first and second ends 38, 42 of the generally elongated hollow airfoil 30.

In at least one embodiment, each of the first and second pressure side cooling chambers 68, 70 may be formed from a first pressure side leg 74, a second suction side leg 76, and a third suction side leg 78. The legs 74, 76, 78 may be aligned with each other and may extend in a generally spanwise direction in the elongated airfoil 30. The first and second pressure side cooling chambers 68, 70 may be configured such that the first pressure side leg 74 may be in communication with a cooling fluid supply source 28 through one or more orifices 80 in the outer endwall 34. The first and second pressure side cooling chambers 68, 70 may be configured such that the first pressure side leg 74 is positioned closest to the trailing edge 46 and the third pressure side leg 78 is positioned closest to the leading edge 46. The second pressure side legs 76 may be positioned between the first and third pressure side legs 74, 78. In addition, the first, second, and third pressure side legs, 74, 76, 78 may be in fluid communication with each other with turns 82. One or more trip strips 84 may be positioned in the first, second, and third suction side legs, 74, 76, 78 and may extend inwardly from an inner surface 86 forming the first, second, and third suction side legs, 74, 76, 78. The third leg 78 of the first pressure side serpentine channel 68 may be in fluid communication with a mid-chord cooling fluid collection chamber 98 through one or more orifices 79.

Figure 3:
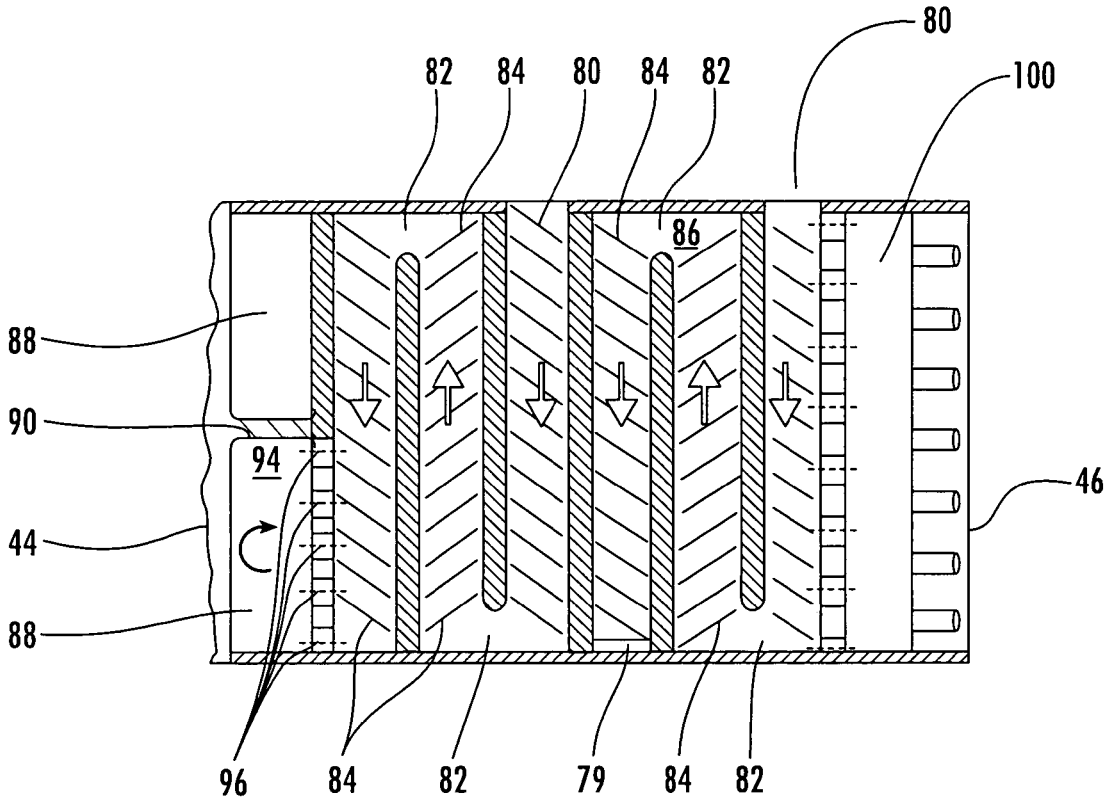
FIG. 3 is a cross-sectional view of a pressure side of the cooling system in the turbine airfoil shown in FIG. 2 taken along line 3-3 in FIG. 2.

The cooling system 10 may also include a leading edge cooling chamber 88 extending in a general spanwise direction along the leading edge 44 of the elongated airfoil 30. The leading edge cooling chamber 88 may be bisected by a rib 90 forming two leading edge cooling chambers 88. The suction side serpentine cooling chamber 18 may deposit cooling fluids into a first leading edge cooling chamber 88, as shown in FIG. 4, and the pressure side serpentine cooling chamber 24 may deposit cooling fluids into a second leading edge cooling chamber 88 positioned inline with the first leading edge cooling chamber 88, as shown in FIG. 3. The leading edge cooling chamber 88 may be in fluid communication with the suction side and pressure side serpentine cooling chambers 18, 24. The two leading edge cooling chambers 88 enable the cooling system 10 to accommodate the suction side and pressure side serpentine cooling chambers 18, 24.

In at least one embodiment, the leading edge cooling chamber 88 may be in communication with the suction side serpentine cooling chamber 18 through one or more suction side vortex orifices 92. The suction side vortex orifice 92 may be positioned inline with an inner surface 94 of the leading edge cooling chamber 88 proximate to the leading edge 44, thereby enabling formation of a vortex of cooling fluids in the leading edge cooling chamber 88 when cooling fluids flow from the suction side serpentine cooling chambers 18 to the leading edge cooling chamber 88.

In at least one embodiment, the leading edge cooling chamber 88 may be in communication with the pressure side serpentine cooling chamber 24 through one or more pressure side vortex orifices 96. The pressure side vortex orifice 96 may be positioned inline with an inner surface 94 of the leading edge cooling chamber 88 proximate to the leading edge 44, thereby enabling formation of a vortex of cooling fluids in the leading edge cooling chamber 88 when cooling fluids flow from the pressure side serpentine cooling chambers 96 to the leading edge cooling chamber 88.

As shown in FIG. 2, the cooling system 10 may include a mid-chord cooling fluid collection chamber 98. The mid-chord cooling fluid collection chamber 98 may extend from the first end 38 to the second end 42 of the airfoil 30, or any length therebetween. The mid-chord cooling fluid collection chamber 98 may be positioned between the leading and trailing edges 44, 46 and between the suction and pressure sides 22, 26. In at least one embodiment, the mid-chord cooling fluid collection chamber 98 may be positioned between the leading edge cooling chamber 88 and the trailing edge impingement chamber 100 and between the suction side and pressure side serpentine cooling chambers 18, 24. The mid-chord cooling fluid collection chamber 98 may be divided into two or more chambers. The leading edge cooling chamber 88 may be in communication with the mid-chord cooling fluid collection chamber 98 through one or more orifices 102. The mid-chord cooling fluid collection chamber 98 may be in communication with the trailing edge impingement chamber 100 through a channel 104.

The trailing edge impingement chamber 100 may have any appropriate configuration. The trailing edge impingement chamber 100 may be in communication with one or more trailing edge exhaust slots 106 enabling cooling fluids to be exhausted from the airfoil 30 through the trailing edge 46.

The cooling system 12 may also include one or more film cooling holes 108. The film cooling holes 108 may extend through the outer wall 20 to place the mid-chord cooling fluid collection chamber 98 in communication with the outer surface 32 of the airfoil 30 to create a boundary layer of cooling fluids.

Ceramic cores may be used to create the cooling system 10 within the turbine airfoil 12. For instance, ceramic cores for each individual serpentine flow channel may be inserted into a wax die prior to the wax injection. A precision joint between the second suction and pressure side serpentine cooling chambers 50, 70 and the leading edge cooling chamber 88, the mid-chord cooling fluid collection chamber 98, and the first suction and pressure side serpentine cooling chambers 48, 68 may be used. After casting and ceramic core leaching, the mid-chord cooling fluid collection chamber 98 and the turns 62, 82 for the suction and pressure side serpentine cooling chambers 18, 24 may be sealed closed.

During use cooling fluids may flow from a cooling fluid supply source 28 into the first and second suction side serpentine cooling chambers 48, 50 and into the first and second pressure side serpentine cooling chambers 68, 70. In the first suction side and pressure side serpentine cooling chambers 48, 68, the cooling fluids may flow through the first, second, and third legs 54, 56, 58 and 74, 76, 78, respectively. The cooling fluids may be passed into the leading edge cooling chamber 88 through the suction side and pressure side vortex orifices 92, 96. Vortices may be formed in the leading edge cooling chamber 88, thereby increasing the effectiveness of the leading edge cooling chamber 88. The cooling fluids may be exhausted from the leading edge cooling chamber 88, through the orifices 102, and into a forward mid-chord cooling fluid collection chamber 110. Cooling fluids may be exhausted through the inner endwall 40 of the airfoil 30 and through the film cooling holes 108.

Cooling fluids entering the second suction side and pressure side serpentine cooling chambers 50, 70 may flow through the first, second, and third legs 54, 56, 58 and 74, 76, 78, respectively. The cooling fluids may be exhausted from the third legs 58, 78 into the aft mid-chord cooling fluid collection chamber 112. The cooling fluids may flow through the channels 104 and into the trailing edge impingement chamber 100. The cooling fluids may then flow through the trailing edge exhaust slots 106 and be exhausted from the airfoil 30.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated hollow airfoil formed from an outer wall, and having a leading edge, a trailing edge, a pressure side, a suction side, an outer endwall at a first end, an inner endwall at a second end opposite the first end;

at least one leading edge cooling chamber extending generally spanwise along the leading edge of the generally elongated hollow airfoil;

a cooling system in the outer wall of the hollow airfoil, comprising:

at least one suction side serpentine cooling chamber comprising first and second suction side legs generally aligned with each other and positioned generally spanwise in the outer wall forming the suction side, wherein a first suction side leg receives cooling fluids from a cooling fluid supply source and a second suction side leg of the suction side serpentine cooling chamber is positioned between the first suction side leg and the leading edge of the generally elongated airfoil; and at least one pressure side serpentine cooling chamber comprising first and second pressure side legs generally aligned with each other and positioned generally spanwise in the outer wall forming the pressure side, wherein a first pressure side leg receives cooling fluids from a cooling fluid supply source and a second pressure side leg of the pressure side serpentine cooling chamber is positioned between the first pressure side leg and the leading edge of the generally elongated airfoil;

at least one vortex forming orifice in the outer wall that places the suction side serpentine cooling chamber in communication with the at least one leading edge cooling chamber such that at least one vortex may form in the at least one leading edge cooling chamber when cooling fluids flow from the suction side serpentine cooling chamber into the at least one leading edge cooling chamber, and further comprising at least one vortex forming orifice in the outer wall that places the pressure side serpentine cooling chamber in communication with the at least one leading edge cooling chamber such that at least one vortex may form in the at least one leading edge cooling chamber when cooling fluids flow from the pressure side serpentine cooling chamber into the at least one leading edge cooling chamber.

2. The turbine airfoil of claim 1, wherein the at least one suction side serpentine cooling chamber comprises first and second suction side cooling chambers positioned in the outer wall forming the suction side of the airfoil.

3. The turbine airfoil of claim 2, wherein the first suction side serpentine cooling chamber further comprises a third suction side leg positioned between a second suction side leg of the first suction side serpentine cooling chamber and a first suction side leg of the second suction side serpentine cooling chamber, and the second suction side serpentine cooling chamber further comprises a third suction side leg positioned between a second suction side leg of the second suction side serpentine cooling chamber and the leading edge of the generally elongated hollow airfoil.

4. The turbine airfoil of claim 3, further comprising at least one mid-chord cooling fluid collection chamber positioned between the leading and trailing edges and between the suction and pressure side serpentine cooling channels, wherein the third leg of the first suction side serpentine cooling channel is in communication with the at least one mid-chord cooling fluid collection chamber and wherein the third leg of the second suction side serpentine cooling channel is in communication with the at least one mid-chord cooling fluid collection chamber.

5. The turbine airfoil of claim 2, wherein the first leg of the first suction side serpentine cooling channel is in fluid communication with a cooling fluid supply source through an orifice in the first end of the generally elongated hollow airfoil.

6. The turbine airfoil of claim 5, wherein the first leg of the second suction side serpentine cooling channel is in fluid communication with a cooling fluid supply source through an orifice in the first end of the generally elongated hollow airfoil.

7. The turbine airfoil of claim 1, wherein the at least one suction side serpentine cooling chamber further comprises a third suction side leg positioned between the second suction side leg and the leading edge.

8. The turbine airfoil of claim 7, further comprising at least one mid-chord cooling fluid collection chamber positioned between the leading and trailing edges and between the suction and pressure side serpentine cooling channels, wherein the third suction side leg is in communication with the mid-chord cooling fluid collection chamber.

9. The turbine airfoil of claim 8, further comprising at least one film cooling orifice extending through the outer wall on the suction side and in communication with the mid-chord cooling fluid collection chamber.

10. The turbine airfoil of claim 1, wherein the at least one pressure side serpentine cooling chamber comprises first and second pressure side cooling chambers positioned in the outer wall forming the pressure side of the airfoil.

11. The turbine airfoil of claim 10, wherein the first pressure side serpentine cooling chamber further comprises a third pressure side leg positioned between a second pressure side leg of the first pressure side serpentine cooling chamber and a first pressure side leg of the second pressure side serpentine cooling chamber, and the second pressure side serpentine cooling chamber further comprises a third pressure side leg positioned between a second pressure side leg of the second pressure side serpentine cooling chamber and the leading edge of the generally elongated hollow airfoil.

12. The turbine airfoil of claim 11, further comprising at least one mid-chord cooling fluid collection chamber positioned between the leading and trailing edges and between the suction and pressure side serpentine cooling channels, wherein the third leg of the first pressure side serpentine cooling channel is in communication with the at least one mid-chord cooling fluid collection chamber and wherein the third leg of the second pressure side serpentine cooling channel is in communication with the at least one mid-chord cooling fluid collection chamber.

13. The turbine airfoil of claim 10, wherein the first leg of the first pressure side serpentine cooling channel is in fluid communication with a cooling fluid supply source through an orifice in the first end of the generally elongated hollow airfoil.

14. The turbine airfoil of claim 13, wherein the first leg of the second pressure side serpentine cooling channel is in fluid communication with a cooling fluid supply source through an orifice in the first end of the generally elongated hollow airfoil.

15. The turbine airfoil of claim 1, wherein the at least one pressure side serpentine cooling chamber further comprises a third pressure side leg positioned between the second pressure side leg and the leading edge.

16. The turbine airfoil of claim 15, further comprising at least one mid-chord cooling fluid collection chamber positioned between the leading and trailing edges and between the suction side and pressure side serpentine cooling channels, wherein the third pressure side leg is in communication with the mid-chord cooling fluid collection chamber.

17. The turbine airfoil of claim 16, further comprising at least one film cooling orifice extending through the outer wall on the pressure side and in communication with the mid-chord cooling fluid collection chamber.

18. A turbine airfoil, comprising:

a generally elongated hollow airfoil formed from an outer wall, and having a leading edge, a trailing edge, a pressure side, a suction side, an outer endwall at a first end, an inner endwall at a second end opposite the first end;

at least one leading edge cooling chamber extending generally spanwise along the leading edge of the generally elongated hollow airfoil;

a cooling system in the outer wall of the hollow airfoil, comprising:

first and second suction side serpentine cooling chambers positioned in the outer wall forming the suction side of the airfoil, each comprising first and second legs generally aligned with each other and positioned generally spanwise in the outer wall forming the suction side, wherein a first suction side leg receives cooling fluids from a cooling fluid supply source and a second suction side leg of the suction side serpentine cooling chamber is positioned between the first suction side leg and the leading edge of the generally elongated airfoil;

first and second pressure side serpentine cooling chambers positioned in the outer wall forming the pressure side of the airfoil, each comprising first and second legs generally aligned with each other and positioned generally spanwise in the outer wall forming the pressure side, wherein a first pressure side leg receives cooling fluids from a cooling fluid supply source and a second pressure side leg of the pressure side serpentine cooling chamber is positioned between the first pressure side leg and the leading edge of the generally elongated airfoil;

at least one mid-chord cooling fluid collection chamber positioned between the leading and trailing edges and between the pressure and pressure side serpentine cooling channels;

wherein the suction side serpentine cooling chamber is in fluid communication with the at least one leading edge cooling chamber through at least one suction side vortex orifice;

wherein the pressure side serpentine cooling chamber is in fluid communication with the at least one leading edge cooling chamber through at least one pressure side vortex orifice;

wherein the at least one leading edge cooling chamber is in fluid communication with the at least one mid-chord cooling fluid collection chamber through at least one orifice in a rib separating the at least one leading edge cooling chamber from the at least one mid-chord cooling fluid collection chamber;

at least one trailing edge impingement cavity positioned proximate to the trailing edge and in fluid communication with the at least one mid-chord cooling fluid collection chamber; and at least one trailing edge slot extending from the at least one trailing edge impingement cavity through the outer wall to the trailing edge.

19. The turbine airfoil of claim 18, wherein the first and second suction side serpentine cooling chambers each are formed from at least three suction side legs, and wherein the first and second pressure side serpentine cooling chambers each are formed from at least three pressure side leg.

* * * * *